US007374515B2

(12) United States Patent
Slawinski et al.

(10) Patent No.: US 7,374,515 B2
(45) Date of Patent: May 20, 2008

(54) BARBELL AND DUMBBELL SAFETY SPOTTING APPARATUS

(76) Inventors: Michael D. Slawinski, 1601 Wickersham Pl., Suwanee, GA (US) 30024; Mikael L. E. Olsson, 12 Bucks Point, Hoschton, GA (US) 30548

( * ) Notice: Subject to any disclaimer, the term of this patent is extended or adjusted under 35 U.S.C. 154(b) by 539 days.

(21) Appl. No.: 10/697,633

(22) Filed: Oct. 29, 2003

(65) Prior Publication Data

US 2004/0092369 A1 May 13, 2004

Related U.S. Application Data

(62) Division of application No. 10/100,673, filed on Mar. 18, 2002, now Pat. No. 6,669,607, which is a division of application No. 09/201,434, filed on Nov. 30, 1998, now Pat. No. 6,379,287.

(51) Int. Cl.
*A63B 21/00* (2006.01)

(52) U.S. Cl. ..... 482/104; 482/106; 482/108

(58) Field of Classification Search ..... 482/104, 482/106, 107, 108

See application file for complete search history.

(56) References Cited

U.S. PATENT DOCUMENTS

| | | | | |
|---|---|---|---|---|
| 2,603,520 | A * | 7/1952 | Brown et al. | 294/26 |
| 3,888,535 | A * | 6/1975 | Rosso | 294/19.1 |
| 4,998,721 | A * | 3/1991 | Anders et al. | 482/4 |
| 5,573,484 | A | 11/1996 | Carpenter | |
| 5,651,758 | A * | 7/1997 | Cervantes | 482/93 |
| 5,823,921 | A * | 10/1998 | Dawson | 482/104 |
| 5,979,840 | A * | 11/1999 | Hollister et al. | 248/76 |
| 5,989,166 | A * | 11/1999 | Capizzo et al. | 482/104 |
| 6,893,381 | B2 * | 5/2005 | Slawinski | 482/8 |

* cited by examiner

*Primary Examiner*—Jerome Donnelly
(74) *Attorney, Agent, or Firm*—Kenneth S. Watkins, Jr.

(57) ABSTRACT

A dumbbell clamp for a barbell and dumbbell safety spotting apparatus [30] utilizes two spaced-apart plates [162] each having a notch [166] for retaining the grip [28] of a dumbbell [26]. A spring-biased lock bar [170] locks the dumbbell grip in the notches during normal use. A clamp bore [178] is provided for secure the dumbbell clamp to a cable [72] by use of a hook [86]. A hand switch receptacle [82] provides an electrical connector from a hand switch [88] on the dumbbell clamp to the safety spotting apparatus.

10 Claims, 12 Drawing Sheets

BARBELL AND DUMBBELL SAFETY SPOTTING APPARATUS

This Application is a Divisional Application of application Ser. No. 10/100,673 filed Mar. 18, 2002 now U.S. Pat. No. 6,669,607 , which is a Divisional Application of application Ser. No. 09/201,434 filed Nov. 30, 1998, issued as U.S. Pat. No. 6,379,287.

BACKGROUND OF THE INVENTION

I. Field of the Invention

The present invention relates generally to the field of exercise equipment. More particularly, the present invention relates to an apparatus which safely self-spots a weightlifter exercising with barbell or dumbbell assemblies.

II. Description of the Related Art

Athletes of many disciplines, including weightlifters, improve their strength and endurance by including weight training within their workout regimens. It is generally recognized that superior results occur when the athlete, or lifter, utilizes free weights in the weight training program, which provide the lifter with full range of motion and control. One common and effective program for lifters to increase overall muscle strength is to repetitively lift a predetermined weight for a predetermined number of sets. For maximum body muscle strength, the lifter attempts to exert all of his or her strength on the last one or two repetitions of each set. Another popular and effective program is for the lifter to repetitively lift a predetermined weight until the lifter's muscles reach a point of almost complete exhaustion. However, for the lifter to safely utilize either program with free weights, it is both desirable and generally necessary for the lifter to engage the assistance of one or more spotters to observe the lifter during his or her exercise program. The spotters help lift and remove the weight when the lifter no longer has sufficient strength or energy to place the weight back to a stored position, typically on support arms of a weight support or a weight bench. Conducting these programs without a spotter is extremely dangerous to the lifter. Muscle exertion and exhaustion may cause the lifter to lose control of the weights, leading to the weights being uncontrollably dropped onto and injuring the lifter. Commonly, the lifter is unable to obtain a spotter before commencing the repetitive weight lifting programs of these types. As a result, the lifter is faced with the dilemma of either ignoring proper safety procedures and conducting the weight lifting exercises without the use of spotters or not conducting the weight lifting program altogether. This dilemma can occur whether the lifter utilizes dumbbells or weights removably mounted on a barbell.

The weightlifting industry developed various devices that utilize motors to lift a weighted barbell for a lifter and eliminate the need for spotters. Typically, these devices have two movable cables traveling on respective, spaced-apart pulleys located at fixed positions on a frame. Distal ends of the cables are connected to the barbell, and proximal ends of the cables are operably connected to a single motor. The barbell is raised and lowered by respectively retracting and extending the cables by the motor. However, the motor must be activated for the cables to retract or extend, and the cables either extend or retract together, but not independently. Examples of such devices are described in U.S. Pat. Nos. 4,949,959 and 5,048,826.

To provide independent travel of the cables, the weightlifting industry developed devices which utilize a separate motor for each cable. For example, each cable retracts and extends from a drum which is operably mounted to a motor, as shown in U.S. Pat. No. 4,998,721. Although each motor can actuate independently of the other, the motors are under constant low-level actuation to maintain tension on the cables, which requires the use of sensors. Also, since the cables respectively suspend from drums located at fixed positions with respect to the frame, the distance between the cables cannot be varied to accommodate different sized barbells or permit the use of dumbbells as "free-weights" with the cables traveling along a substantially vertical path.

In an effort to alleviate the requirement of maintaining an actuated motor during a workout, the weightlifting industry enlisted the use of motor-clutch assemblies. For example, as shown in U.S. Pat. No. 5,314,394, two sets of chains are disposed on respective upper and lower sprockets. The lower sprockets are mounted onto a rotatable shaft operably connected to a motor through a clutch. An arm support assembly, which receives a barbell, is slidably mounted to vertical shafts and connected to the chains. While the lifter is exercising, the motor is not energized, allowing the shaft to freely spin as the arm support assembly moves along the vertical shafts. Once the lifter desires the device to lift the barbell, the lifter causes clutch to engage the shaft which permits the motor to controllably rotate the shaft and lift the barbell. However, the arm support assembly is not capable of providing "free-weight" full range of motion. Additionally, the chains can not move around their respective sprockets independently of the other.

Thus, there remains a need for a free-weight device which self-spots a lifter with the benefit of an unactuated motor or winch. Further, there remains a need for a free-weight device which self-spots a lifter that provides independent reciprocating movement of a pair of cables which are securable from movement to support the weight of the weight assembly. In addition, there exists a need with such a device for a clutch which provides independent reciprocating movement of the cables which are operably connected to the motor. As well, there remains an need for such a device capable of varying the distance between the cables for various sized barbells or for the use of dumbbells. Still, there remains a need for such a device which is capable of securing the dumbbells for a free-weight workout by the lifter. Accordingly, it is to the provision of such that the present invention is primarily directed.

SUMMARY OF THE INVENTION

This invention overcomes the disadvantages of the prior art by providing a barbell and dumbbell safety spotting apparatus that is simple in design and construction, inexpensive to fabricate, and easy to use. The preferred embodiment of the apparatus comprises a frame, two booms supported by the frame, two cables respectively movably extending from the booms, two reciprocating drives respectively operably connected to the cables to provide reciprocating movement of the cables, a rotary pawl clutch operably reciprocating movement of the cables and a motor assembly capable of retracting and extending the cables. The cables are connectable to the barbell or the dumbbells and provide reciprocating movement thereto in free-weight fashion. The booms are pivotally mounted to the frame so that the distance between the cables is variable.

The reciprocating drive comprises an endless chain movably and operably extending about a rotatable sprocket gear and a rotatable drive shaft that is operably connected to the motor assembly, which is lockable to prevent rotation of the drive shaft. Counterweights are mounted to the chains to maintain tension on and assist in retracting the cables. The cables are respectively attached to the counterweights to prevent binding of the cables during reciprocating motion thereof or during pivotal movement of the booms. Independent reciprocating movement of each reciprocating drive is provided by operably connecting the respective chain to the drive shaft with the rotary pawl clutch.

The rotary pawl clutch comprises a pawl base, at least one pawl pivotally mounted to the pawl base for each reciprocation drive, a solenoid mounted to the pawl base for each pawl to actuate the pawl, and a ratchet-sprocket gear engagable with the pawl. The pawl base is fixedly mounted to and rotates with the drive shaft. The ratchet-sprocket gear has a ratchet wheel portion and a sprocket portion. The ratchet-sprocket gear is rotatably mounted on the drive shaft with the ratchet wheel portion adjacent the pawl base. The ratchet wheel portion has a plurality of substantially evenly spaced indentations along the circumference thereof which are removably engagable with the pawl to prevent both rotation of the ratchet-sprocket gear and movement of the chain such that the respective cable is prohibited from extending from the boom.

Dumbbells are suspendable from the respective cables by dumbbell clamps removably attached thereto. Each dumbbell clamp has a two spaced-apart plates mounted to one another and the plates are substantially identical in shape. The plates have a notch for receiving a grip of the dumbbell. An elongated slot intersects the notch, and a locking bar is slidably secured therein. A spring is disposed in each slot to bias the locking bar toward the notch to removably engage the grip, thereby securing the grip within the notch. It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing preferred embodiments of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein.

Figure 1:
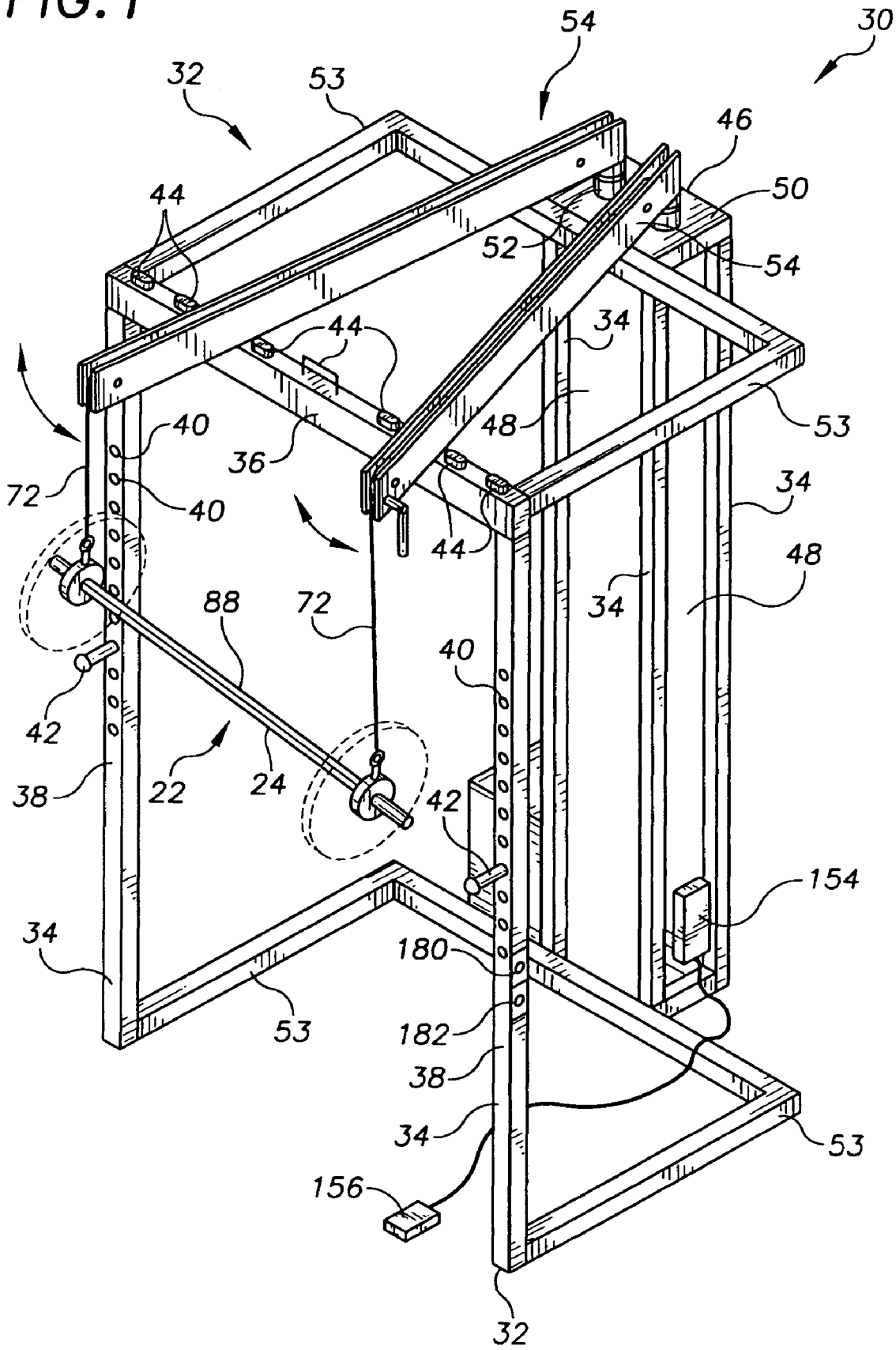
FIG. 1 is a front perspective view of a barbell and dumbbell safety spotting apparatus made in accordance with the present invention.

The reference numbers in the drawings relate to the following:

22=barbell assembly
24=barbell
26=dumbbell
28=grip of dumbbell
30=barbell and dumbbell safety spotting apparatus
32=frame
34=vertical support member
36=boom support
38=face of vertical support member
40=aperture
42=support pin
44=boom stop
46=tower section of frame
48=side wall
50=top wall
52=receptacle
53=stabilizer arm
54=boom
56=bar of boom
58=proximal end of boom
60=distal end of boom
62=pulley
64=boom shaft
66=pivot pin
68=shoulder of pivot pin
70=washer
72=cable
74=loop of cable
76=cable stay
78=combination collar
80=bore
82=female electrical receptacle
84=eye hook
86=J-hook
88=hand switch
90=suspension collar
92=electrical collar
94=collar stop
96=reciprocating drive
98=chain
100=sprocket gear
102=sprocket shaft
104=counterweight

106=opening of counterweight
108=slot of counterweight
110=holes of counterweight and chain
112=stay pin
114=drive shaft
115=shaft opening
116=rotary pawl clutch
118=pawl base
119=key slot
120=pawl
121=pawl head
122=solenoid
123=solenoid arm
124=ratchet-sprocket gear
126=key
128=solenoid bracket
130=base opening
132=electrical wiring
133=hollow of ratchet-sprocket gear
134=ratchet wheel portion of ratchet-sprocket gear
135=indentation of ratchet wheel portion
136=sprocket portion of ratchet-sprocket gear
138=bushing
140=core of drive shaft
142=motor assembly
144=motor
146=motor brake
148=reduction gear
150=counterweight stops
152=counterweight switch
154=junction enclosure
156=override switch
158=male electrical connector
160=dumbbell clamps
162=plate
164=post
166=notch
168=slot
170=locking bar
172=cap
174=handle
176=spring
178=clamp bore
180=extension switch
182=retraction switch

DESCRIPTION OF THE PREFERRED EMBODIMENTS

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1. FIG. 1 of the drawings illustrates a barbell and dumbbell safety spotting apparatus 30 made in accordance with the present invention. The apparatus 30 is operative for assisting a weightlifter in the use of a weight assembly, such as a barbell assembly 22 or a pair of dumbbells 26, by supporting the weight of the weight assembly upon command of the weightlifter in the event the weightlifter is unable to lift or control the weight assembly. The barbell assembly 22 is of conventional construction and comprises a barbell 24 and a plurality of weights removably mounted thereon. The barbell 24 is further discussed below. Likewise, the dumbbell 26 is of conventional construction and comprises a grip 28 and a pair of spaced apart weights which are either removably or fixedly mounted thereon.

Figure 2:
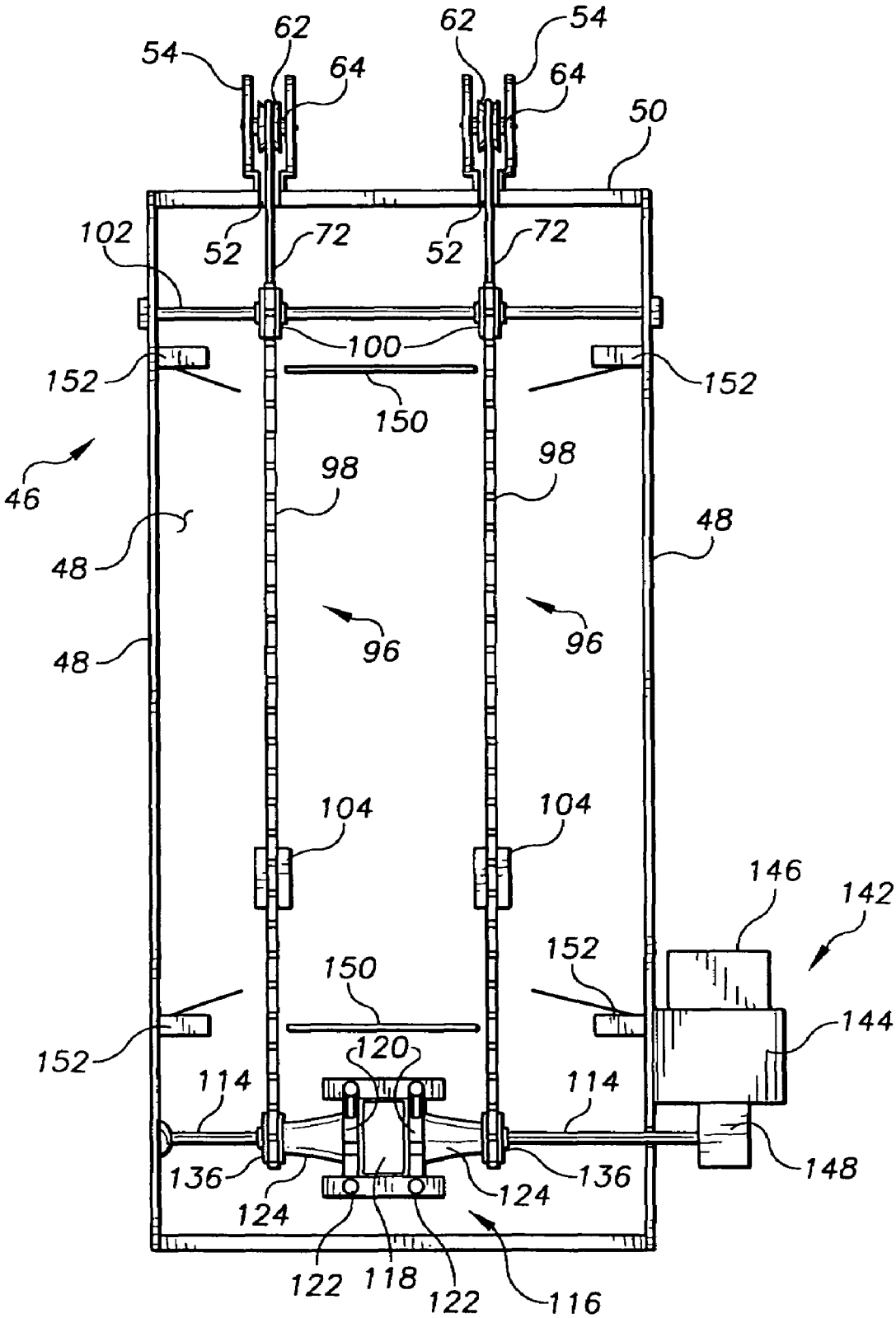
FIG. 2 is a partial back elevation view of the safety spotting apparatus illustrating reciprocating drives.

With continued reference to FIG. 1 and additionally to FIG. 2, the preferred embodiment of the apparatus 30 comprises a frame 32, two booms 54, two cables 72, two reciprocating drives 96, a rotary pawl clutch 116 and a motor assembly 142. The cables 72 are connectable to the barbell 24 or the dumbbells 26 and retract and extend from the respective booms 54 to provide reciprocating vertical movement of the weight assembly in free-weight fashion. Normally, the cables 72 extend upwardly from the weight assembly to the respective booms 54.

The frame 32 has two forward vertical support members 34 loftily supporting a boom support 36. Along a front face 38 of these vertical support members 34 are a plurality of apertures 40 which removably receive support pins 42. The support pins 42 are provided to receive the barbell 24 when the barbell 24 is not in use. The height of the pins 42 above ground or a supporting surface is variable and can be predetermined by the weightlifter by placing the pins 42 in the desire apertures 40.

A plurality of boom stops 44 are disposed along the upper most portion of the boom support 36 at predetermined positions to prevent undesired pivoting of the booms 54. The boom stops 44 allow the weightlifter to adjust and maintain a desired distance between the cables 72 to accommodate various sized barbells 24 or to comfortably conduct a workout utilizing dumbbells 26. Rearwardly disposed in relation to the boom support 36 is the tower section 46 of the frame 32. The tower section 46 has a plurality of vertical support members 34 and side walls 48 mounted to the vertical support members 34. Sound insulation (not shown) is mounted to the side walls 48 within the tower section 46 to reduce noise during operation of the apparatus 30. A top wall 50 is mounted to and supported by the vertical support members 34 of the tower section 46. Extending through the top wall 50 are two cylindrically shaped recepticals 52. Stabilizer arms 53 extend between the upper and lower most portions of the forward vertical support members 34 and the tower section 46 to provide rigidity to the frame 32. With respect to the weight assembly, the stabilizer arms 53 are non-load bearing.

Figure 3:
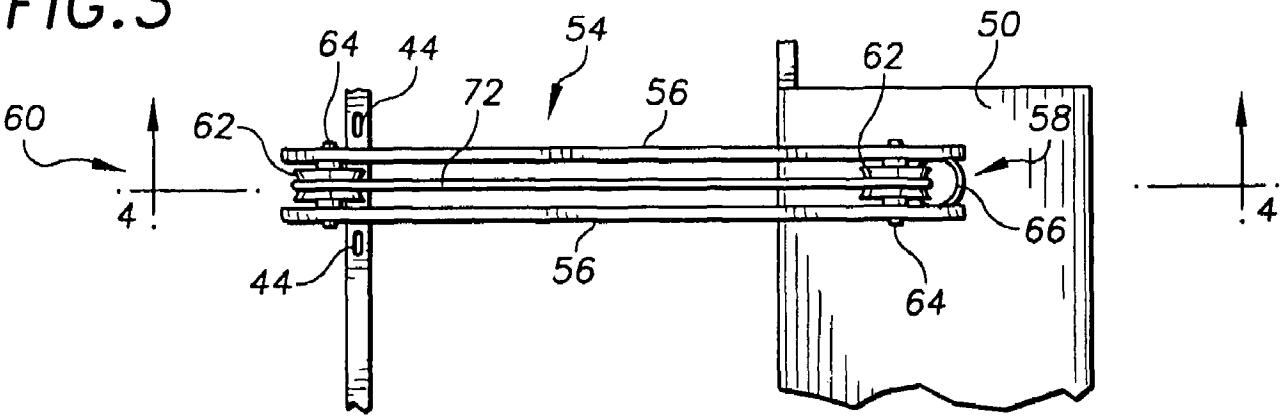
FIG. 3 is a partial top view of the safety spotting apparatus illustrating a cable movably suspended on a boom.
Figure 4:
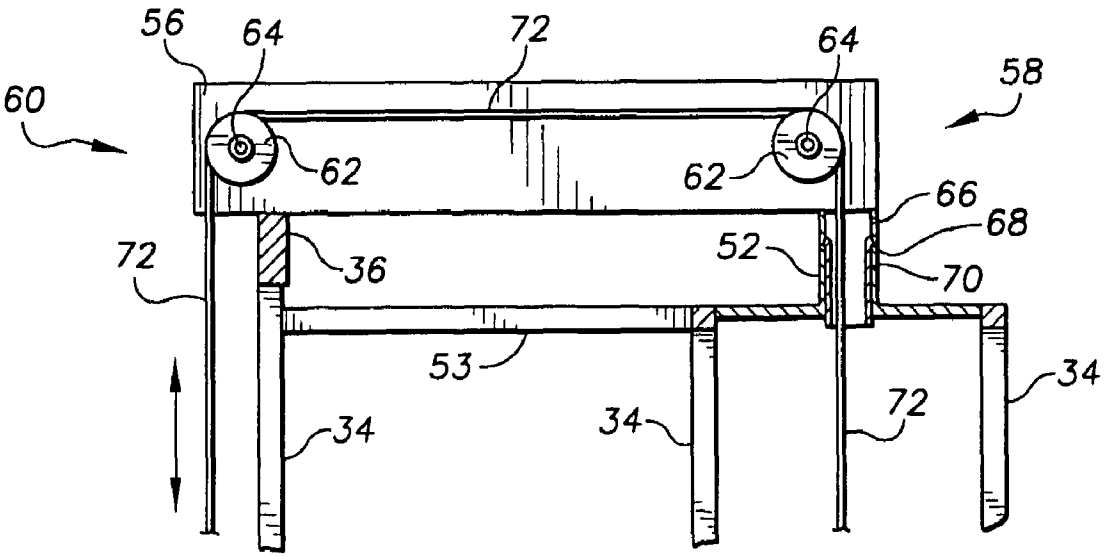
FIG. 4 is a partial side elevation view of the boom taken along line 4-4 of FIG. 3.
Figure 6:
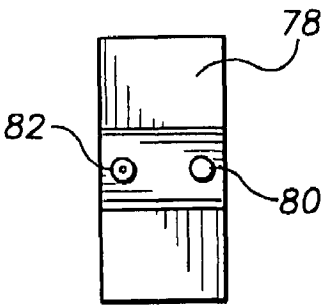
FIG. 6 is a top view of the combination collar.

Referring additionally to FIGS. 3 and 4, the booms 54 comprise two spaced apart, elongated bars 56 and have a proximal end 58 and a distal end 60. Two spaced apart pulleys 62 are rotatably mounted on boom shafts 64 between the bars 56 respectively proximate the proximal and distal ends 58 and 60. A hollow pivot pin 66 is mounted to the bars 56 at the proximal end 58, and the pivot pin 66 is matingly and pivotally inserted within the receptacle 52 of the tower section 46. The pivot pin 66 has a shoulder 68, and nylon washers 70 are disposed on the pivot pin 66 between the shoulder 68 and the receptacle 52 to reduce friction therebetween as the boom 54 is pivoted.

As shown in FIGS. 1, 3 and 4, each cable 72 generally extends upwardly from the weight assembly to the distal end 60 of the boom 54. The cable 72 movably engages the two pulleys 62 and extends downwardly through the pivot pin 66 and the receptacle 52 into the tower section 46. Within the tower section 46, the cable 72 is operably connected to one of the reciprocating drives 96 to provide reciprocating movement to the cable 72. The connection to the reciprocating drive 96 is discussed further below.

Figure 7:
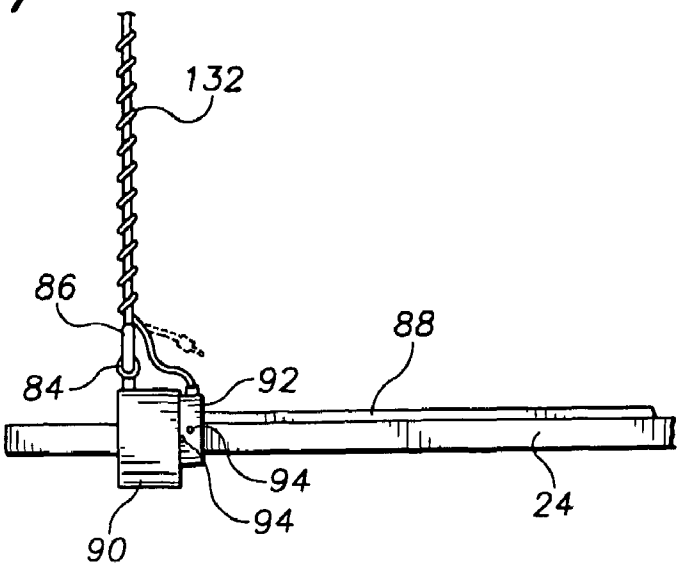
FIG. 7 is a partial front elevation view of the barbell suspended from one of the cables illustrating a switch collar.
Figure 19:
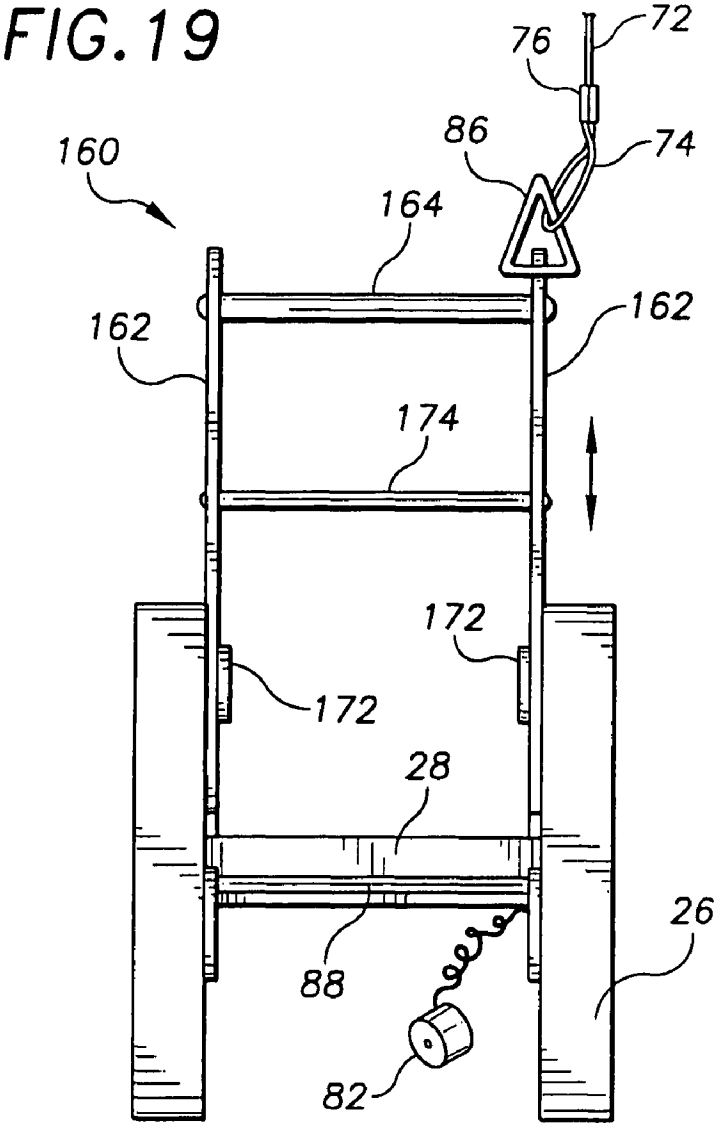
FIG. 19 is a front view of a dumbbell clamp removably engaging a dumbbell; and, FIG. 20 is a side view of the dumbbell clamp.

Referring now to FIGS. 5 through 8 and generally to FIG. 19, the barbell 24 is releasably secured to the cables 72. A loop 74 is formed at the end of the cable 72 and secured with a cable stay 76, as generally shown in FIG. 19. In the embodiment shown in FIGS. 5 and 6, two combination collars 78 are mounted onto the barbell 24 proximate each end thereof. The combination collar 78 has a threaded bore 80 and a female electrical receptacle 82 disposed therein. A matingly threaded eye hook 84 is screwed through the bore 80 into secure engagement with the barbell, thereby preventing rotation of the combination collar 78 and shearing of any electrical connections with the female electrical receptacle 82. The barbell 24 is removably attached to the cable 72 by a releasable J-hook 86 disposed on the loop 74 and inserted through the eye hook 84. Left and right hand switches 88 are mounted to the barbell 24 between the combination collars 78 and respectively electrically connected to the female electrical receptacle 82. In the embodiment shown in FIGS. 7 and 8, two suspension collars 90 are mounted onto the barbell 24 proximate each end thereof. Like the combination collar 78, the suspension collar 78 has a threaded bore 80 to receive the threaded eye hook 84 which is removably attached to the cable 72 as described above. Rotatably mounted to the barbell 24 adjacent each suspension collar 78 and opposite one another are electrical collars 92. Each electrical collars 92 has a female electrical receptacle 82 disposed therein which are electrically connected to the respective hand switches 88. Collar stops 94 extend outwardly from the suspension and electrical collars 90 and 92 in an engagable arrangement, as shown in FIG. 7, to limit rotation of the electrical collar to a predetermined amount.

Figure 9:
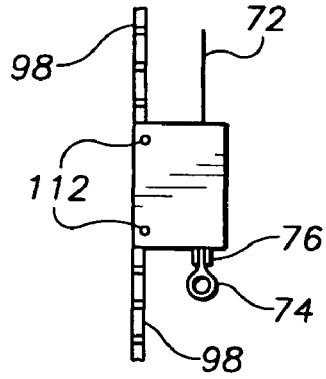
FIG. 9 is a partial side view of a counterweight mounted to the reciprocating drive.
Figure 10:
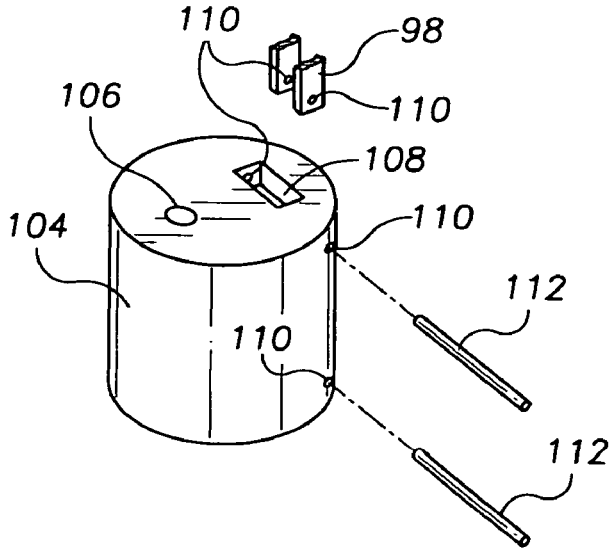
FIG. 10 is a perspective view of the counterweight.

Referring again to FIG. 2 and additionally to FIGS. 9 and 10, the reciprocating drive 96 comprises an endless chain 98 movably and operably extending about a rotatable sprocket gear 100 and a rotatable drive shaft 114. For each cable 72 there is at least one reciprocating drive 96. A sprocket shaft 102 extends between two side walls 48 in the upper portion of the tower section 46, and the sprocket gears 100 are rotatably mounted on the sprocket shaft 102.

To maintain tension on the cable 72 and assist in retracting the cable 72, a counterweight 104 is mounted to the chain 98. The counterweight 104 has an opening 106, and the cable 72 extends through the opening 106. The cable 72 is connected to the counterweight 104 by forming another loop 74 and securing the loop 74 with another cable stay 76, thereby preventing the cable 72 from being withdrawn through the opening 106. The cable 72 descends from the pulley 62 at the proximal end 58 of the boom 54 substantially vertically through the center of the pivot pin 66 and the receptacle 52 to the counterweight 104. In this manner, the cable 72 does not bind as the cable 72 is in reciprocating motion or the booms 54 are being pivoted. On each end of the counterweight 104 are slots 108 to receive an end of the chain 98. The end of the chain 98 is inserted within the slot 108 so that holes 110 extending through the counterweight 104 into the slot 108 and the chain 98 are aligned. Stay pins 112 are inserted into the holes 110 to secure the counterweight 104 to the chain 98.

As stated above, the chain 98 is operably and movably disposed about the drive shaft 114. The manner in which each chain 98 of the reciprocating drives 96 is connected to the drive shaft 114 determines whether each cable 72 is capable of independent movement from the other, thereby providing reciprocating vertical movement of the weight assembly in free-weight fashion. Independent reciprocating movement of each reciprocating drive 96 is provided by operably connecting the respective chain 98 to the drive shaft 114 through a clutch independently dedicated to the respective chain 98. In the present invention, the rotary pawl clutch 116 is utilized to operably connect the chains 98 to the drive shaft 114 and maintain independent movement of the reciprocating drives 96.

With continued reference to FIG. 2 and additionally to FIGS. 11 through 17, the rotary pawl clutch 116 comprises a pawl base 118, at least one pawl 120 having a pawl head 121 pivotally mounted to the pawl base 118, a solenoid 122 mounted to the pawl base 118 and operably connected to the pawl 120 to actuate the pawl 120, and a ratchet-sprocket gear 124 engagable with the pawl 120. The solenoid 122 has an extendable and retractable solenoid arm 123 pivotally mounted to the pawl 120 to affect pivotal movement of the pawl 120 upon actuation of the solenoid 122. Although not required, two sets of pawls 120 and solenoids 122 are utilized for each ratchet-sprocket gear 124 in the present invention. Even though only one pawl 120 and solenoid 122 set is needed for each ratchet-sprocket gear 124, a second set is provided for safety redundancy in the event one of the pawl 120 and solenoid 122 sets fails to operate.

Figure 12:
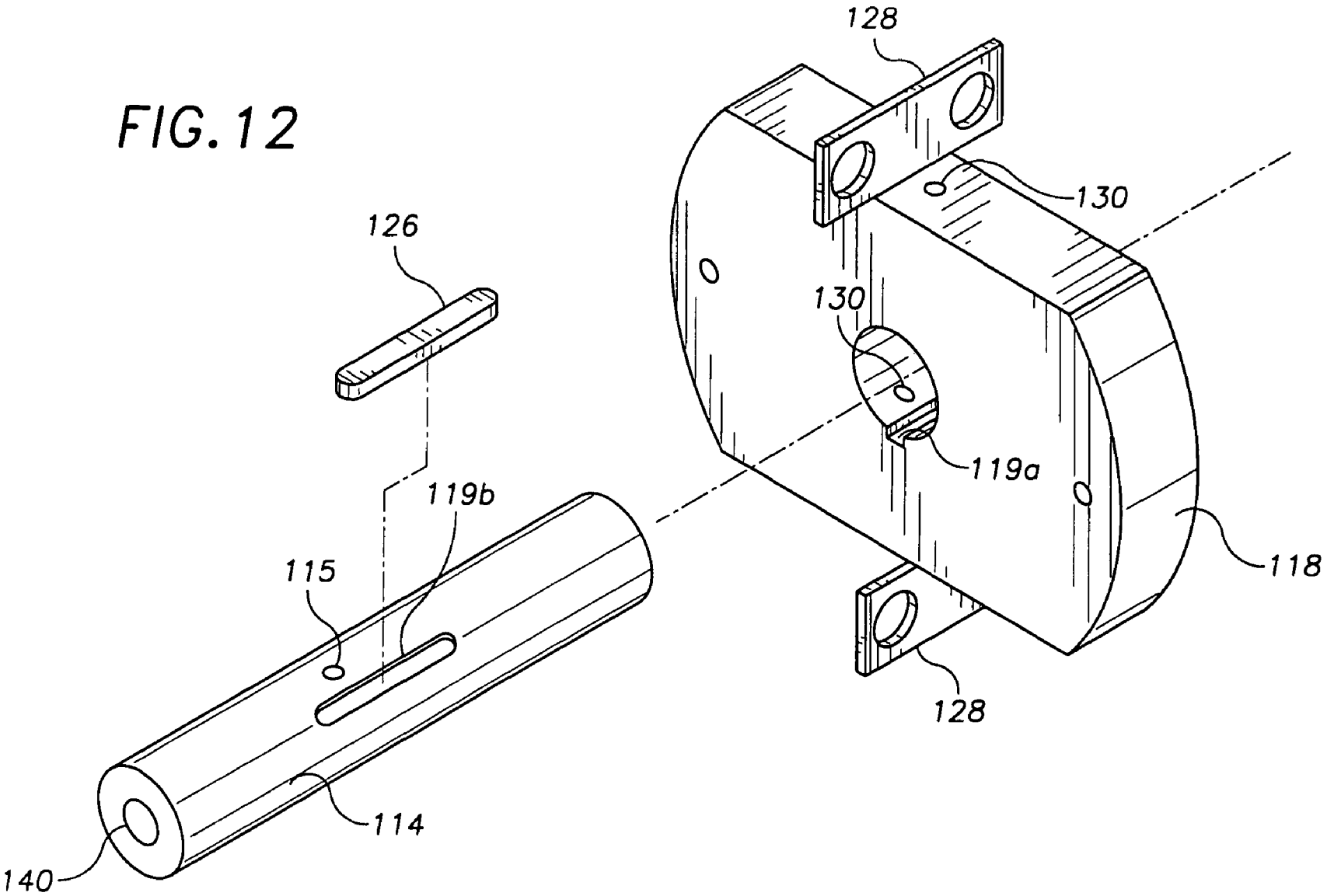
FIG. 12 is an exploded view of a pawl base and a drive shaft.
Figure 15:
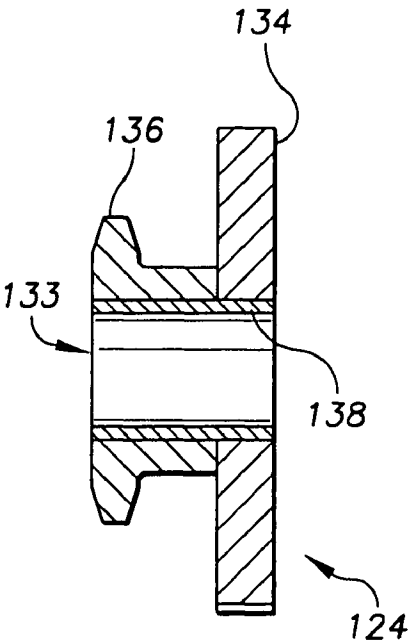
FIG. 15 is a partial side view of the ratchet-sprocket gear and bushing taken along line 15-15 of FIG. 14.

The pawl base 118 is fixedly mounted to and rotates with the drive shaft 114. As shown in FIG. 12, the pawl base 118 and the drive shaft 114 have mating key slots 119*a* and 119*b*, and a mating key 126 is inserted into the key slots 119*a* and 119*b*, locking the pawl base 118 to the drive shaft 114. Solenoid brackets 128 are mounted to the pawl base 118 to receive and hold the solenoids 122. A base openings 130 extend through the pawl base 118 to provide a conduit for electrical wiring 132 that is operably connected to the solenoids 122. As shown in FIG. 12, the drive shaft 114 has a shaft openings 115 positioned such that the base openings 130 align with the shaft openings 115. The electrical wiring 132 extends through the base openings 130 and the shaft openings 115 into a hollow core 140 of the drive shaft 114. The electrical connections are discussed further below.

Figure 11:
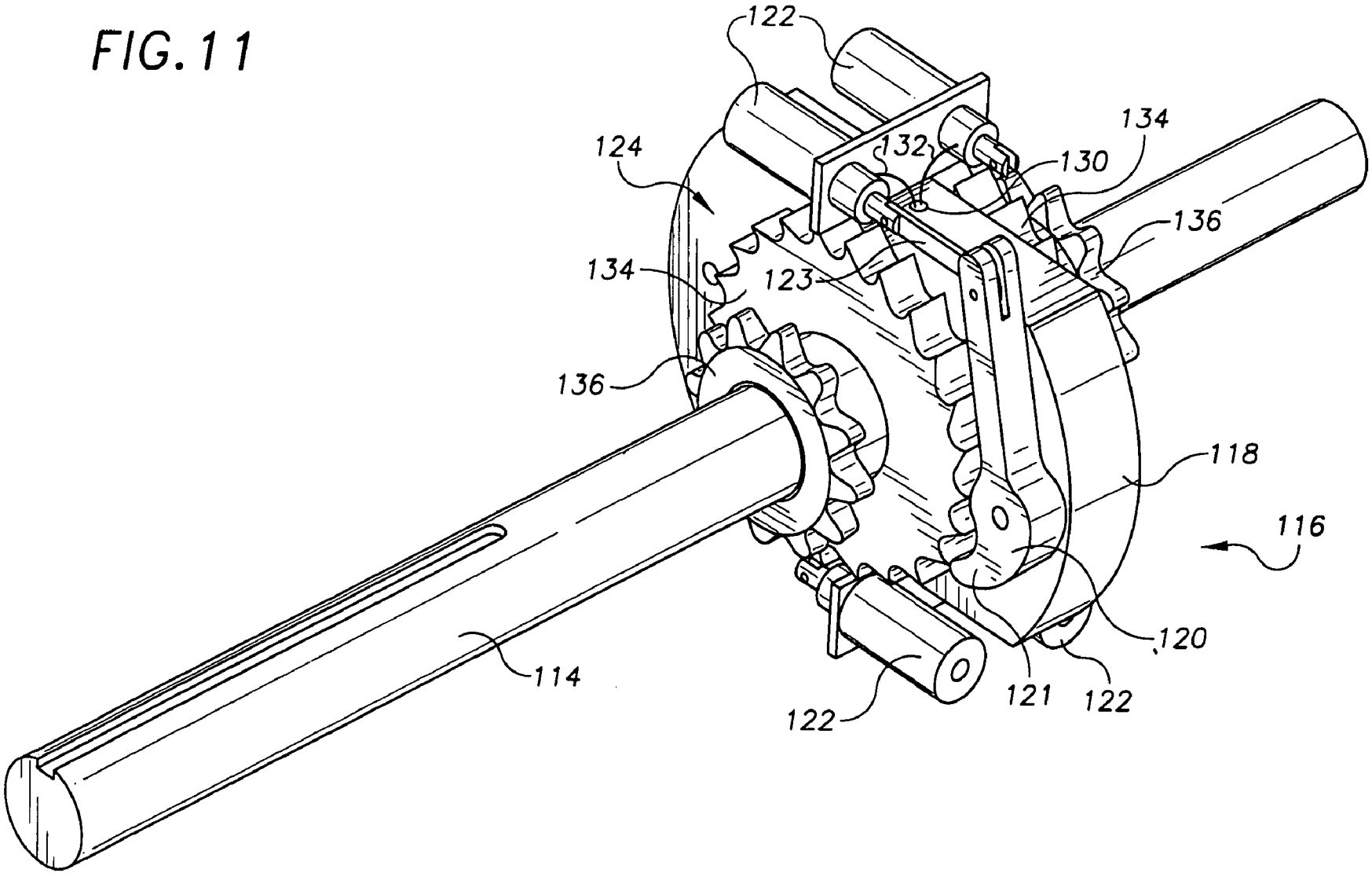
FIG. 11 is a perspective view of a rotary pawl clutch.
Figure 14:
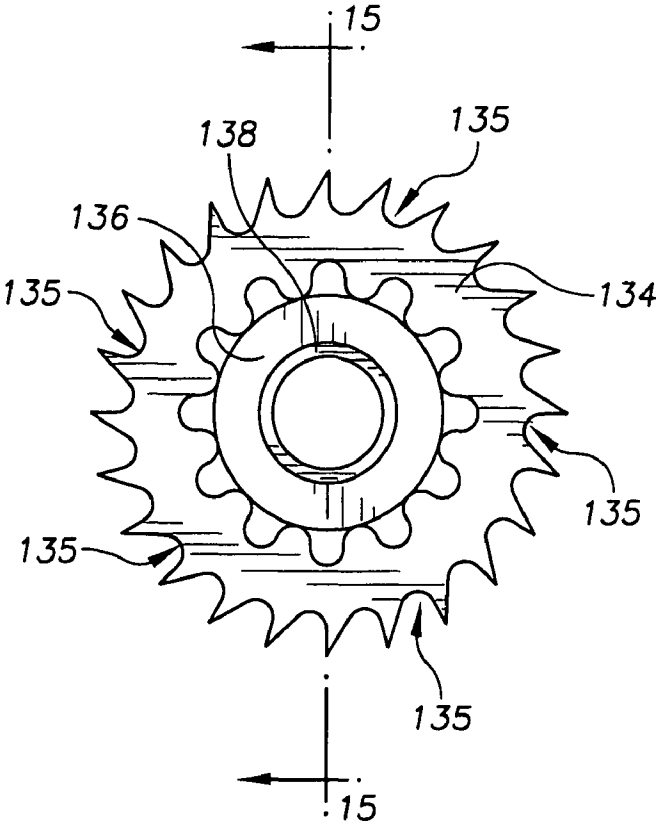
FIG. 14 is a front view of the ratchet-sprocket gear and a bushing therein.
Figure 13:
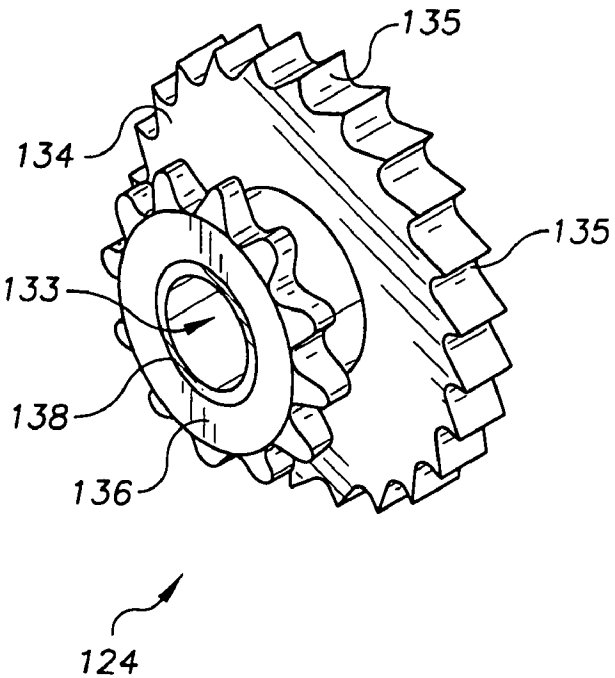
FIG. 13 is a perspective view of a ratchet-sprocket gear.

As shown in FIGS. 11 and 13 through 15, the ratchet-sprocket gear 124 has a cylindrically shaped hollow 133, a ratchet wheel portion 134 and a sprocket portion 136. The ratchet-sprocket gear 124 is rotatably mounted on the drive shaft 114 with the ratchet wheel portion adjacent the pawl base 118, as illustrated in FIG. 11. To reduce rotational friction, a bushing 138, such as a brass bushing, is disposed within the hollow 133 of the ratchet-sprocket gear 124 to rotatably engage the drive shaft 114. The ratchet wheel portion 134 has a plurality of substantially evenly spaced indentations 135 along the circumference thereof. As shown in FIG. 14, the indentations 135 are preferably substantially J-shaped.

Figure 16:
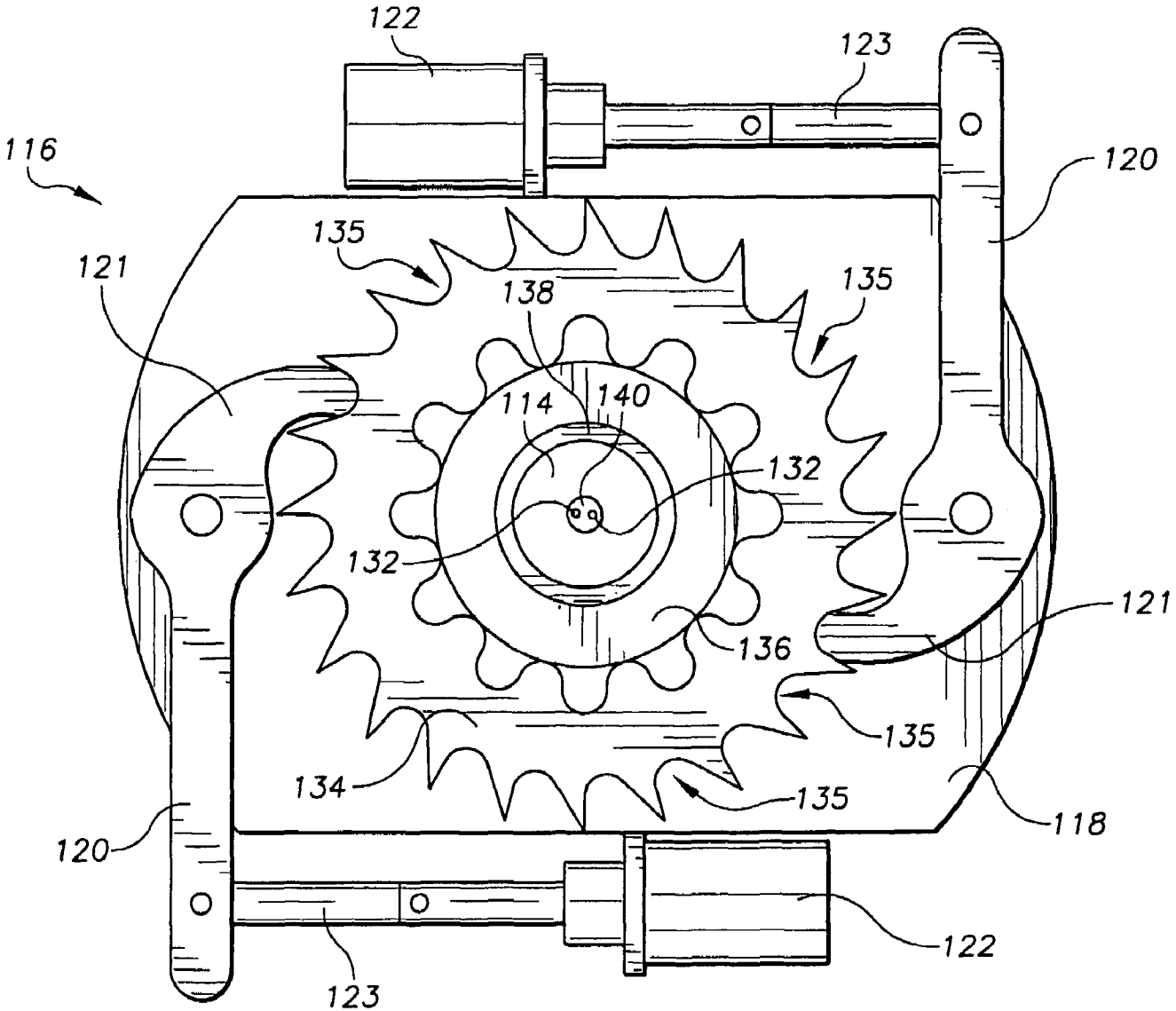
FIG. 16 is a side view of the rotary pawl clutch with pawls engaging a ratchet wheel portion of the clutch.
Figure 17:
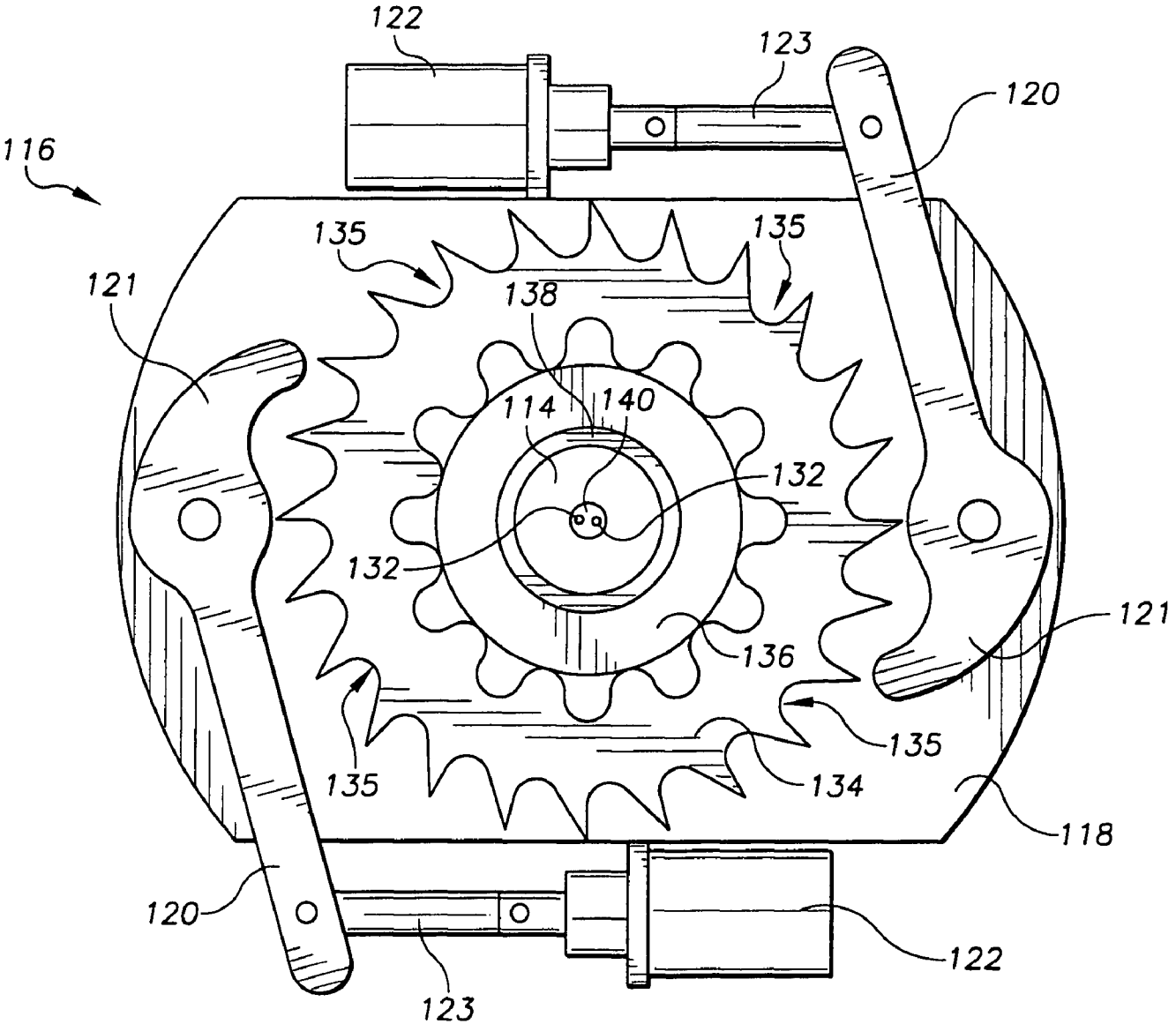
FIG. 17 is a side view of the rotary pawl clutch with the pawls actuated.

Referring additionally to FIGS. 2, 16 and 17, the ratchet-sprocket gear 124 is preferably positioned with the ratchet wheel portion 134 adjacent the pawl base 118. The chain 98 engages the sprocket portion 136 in a manner so that upward vertical movement of the respective, operably connected cable 72 provides clockwise rotation of the ratchet-sprocket gear 124 on the drive shaft 114, with respect to the illustrations shown in FIGS. 16 and 17. In the present invention and as shown in FIG. 16, the solenoid arm 123 is preferably normally biased in an extended position, thereby causing the pawl head 121 to engage one of the indentations 135, which prevents counterclockwise rotational movement of the ratchet-sprocket gear 124 with respect to the pawl base 118. Actuation of the solenoid 122 results in the solenoid arm 123 being retractable and the pawl 120 disengagable with the ratchet wheel portion 134, as shown in FIG. 17. However, due to the J-shape of the indentations 135, the pawl head 121 can not disengage the indentation 135 to permit free rotation of the ratchet-sprocket gear 124 on the drive shaft 114 until the ratchet-sprocket gear 124 is initially rotated clockwise with respect to the pawl base 118. As a result, the respective, operably connected cable 72 must be initially retracted to permit both the pawl head 121 to disengage the respective indentation 135 of the ratchet wheel portion 134 and the solenoid arm 123 to retract and pivot the pawl head 121 outwardly from the ratchet-sprocket gear 124.

Referring again to FIG. 2, the motor assembly 142 is exteriorly mounted to the frame 32 of the tower section 46. The motor assembly 142 comprises a reversible drive motor 144, a motor brake 146 and a reduction gear 148, all of which are conventional. The motor brake 146 is operably connected to the motor 144 to selectively prevent rotation of its motor shaft (not shown) and armature (not shown) The motor shaft is operably connected to the reduction gear 148, which is operably connected to the drive shaft 114. While the motor brake 146 is engaged, the drive shaft 114 is prohibited from rotational movement. Electrical actuation of the motor brake 146 is required to release the motor 144 prior to the drive shaft 114 being operable for rotational movement. Further, in the preferred embodiment, loss of electrical power automatically causes the motor brake 146 to engage and prohibit rotational movement of the drive shaft 114. As stated above, the solenoid arm 123 is biased in the extended position. Thus, loss of electrical power causes the solenoid arm 123 to extend and pivot the pawl 120, which causes the pawl head 121 to engage the ratchet-sprocket gear 124 and prevent counterclockwise rotation thereof. Simultaneously, the motor brake 146 engages the motor 144, which prohibits rotational movement of the drive shaft 114. Because the pawl base 118 is fixedly mounted to the drive shaft 114, the ratchet-sprocket gear 124 is prohibited from counterclockwise movement on the drive shaft. As a result, the cable 72 is prohibited from extending from the boom 54, preventing downward vertical movement of the weight assembly.

Figure 18:
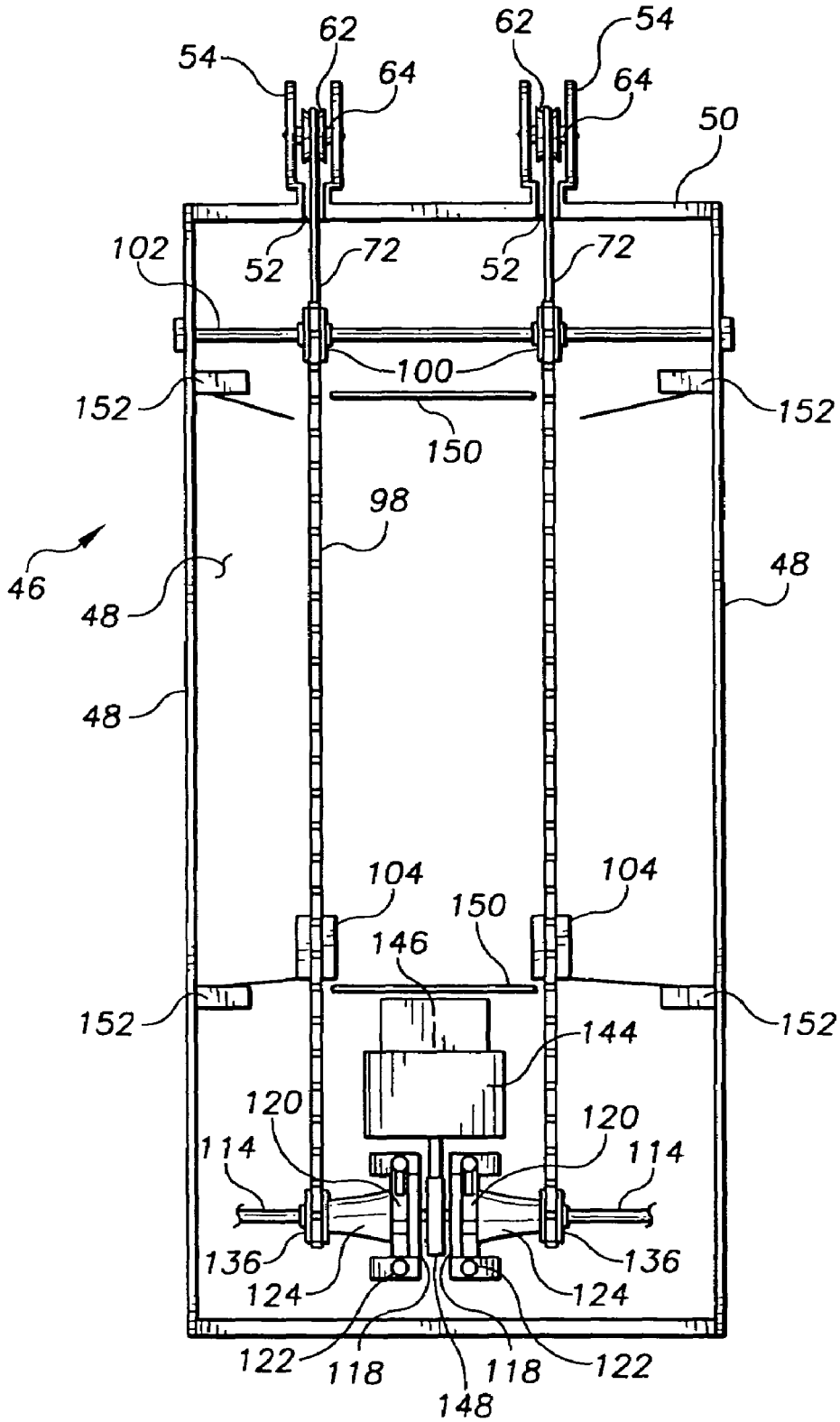
FIG. 18 is a partial side view of the safety spotting apparatus illustrating another embodiment of the rotary pawl clutch.

Now, referring to FIG. 18, another embodiment of the rotary pawl clutch 116 is shown in use with the present invention. In this embodiment, there is one pawl base 118 for each ratchet-sprocket gear 124. This embodiment of the rotary paw clutch 116 operates in the same manner as described above. In use with the present invention, the pawl bases 118 are spaced apart on the drive shaft 114 which extends outwardly in both directions from the reduction gear 148. The reduction gear 148 is operably connected to the motor 144, which is mounted to the frame 32 within the tower section 46. As described above, the motor brake 146 is operably connected to the motor 144 and operates as described above.

As shown in FIGS. 2 and 18, counterweight stops 150 are mounted to the frame 32 within the tower section 46 adjacent the sprocket shaft 102 and the drive shaft 114. The counterweight stops 150 are positioned to engage and block the counterweights 104 from contacting the sprocket gears 100 and the sprocket portions 136 of the sprocket-ratchet gears 124 while the chains 96 of the reciprocating drives are in reciprocating motion with the motor 144 disengaged and the rotatory pawl clutch 116 actuated. Further, counterweight switches 152 are likewise mounted to the frame 32 within the tower section 46 adjacent the sprocket and drive shafts 102 and 114 proximate the chains 98. The counterweight switches 152 are operably and electrically connected to the motor 144. Upon contact of any of the counterweight switches 152 by a counterweight 104 while the motor 144 is selectively activated and the rotary pawl clutches 116 are not actuated, electrical power is interrupted to the motor 144, which terminates rotation of the drive shaft 114 and prevents the counterweights 104 from contacting the sprocket gears 100 and the sprocket portions 136 of the sprocket-ratchet gears 124.

Figure 5:
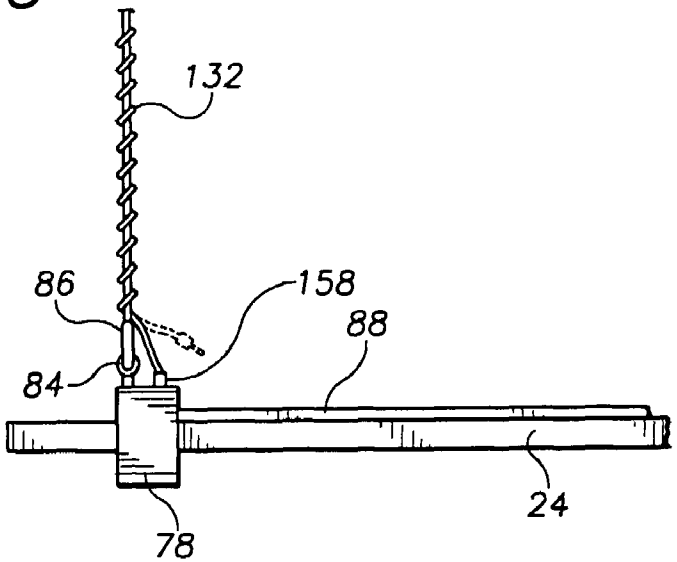
FIG. 5 is a partial front elevation view of a barbell suspended from one of the cables by a combination collar.
Figure 8:
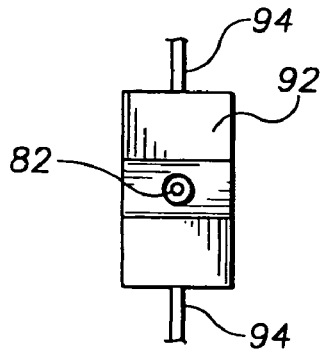
FIG. 8 is a top view of the switch collar.

Referring additionally to FIGS. 1, 5 and 7, the electrical connections and switches of the present invention are conventional. However, the manner of use thereof is not conventional. An electrical junction enclosure 154 is provided to operably and electrically connect the switches generally to either the rotary pawl clutch 116 or the motor 144. Although not required, in the preferred embodiment of the invention the left and right hand switches 88 are operably connected to one another so that both hand switches 88 must be activated to actuated the solenoids 122 of the rotary pawl clutch 116. An override switch 156 is provided so that upon its activation the electrical connection from the hand switches 88 to the solenoids 122 is interrupted, which causes the pawls 120 to engage the ratchet-sprocket gear 124, and the motor 144 is simultaneously activated to retract the cables 72 and raise the weight assembly. As shown in FIGS. 5 and 7, male electrical connectors 158 are operably and electrically connected to additional electrical wiring 132 which is spiral wrapped around the respective cable 72 and operably and electrically connected to the enclosure 154. The male connector 158 removably engages the receptacle 82 and electrically connects the respective hand switch 88 to the enclosure 154 and the solenoids 122. As stated above, electrical wiring 132 extends from each solenoid through the pawl base 118 into the core 140 of the drive shaft 114. The wiring is operably and electrically connected to the junction enclosure 154 by conventional means.

Figure 20:
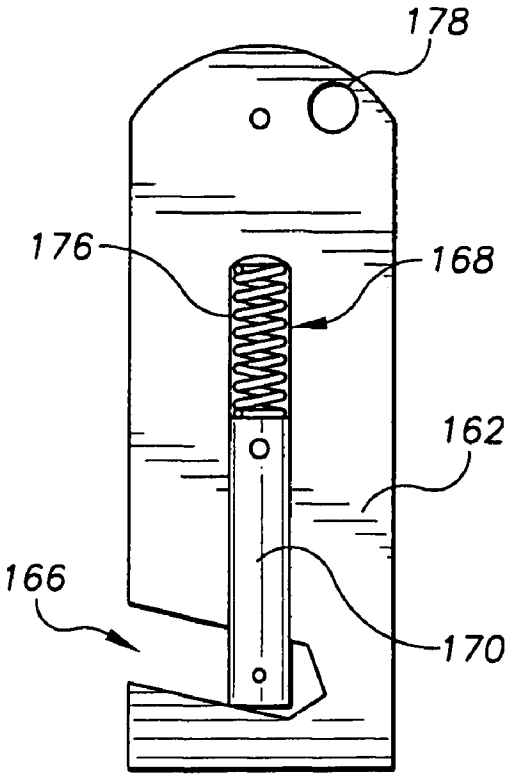

With reference to FIGS. 1, 19 and 20, as stated above the apparatus 30 is operative to assist a weightlifter in the use of dumbbells 26. The dumbbells 26 are suspended from the respective cables 72 by dumbbell clamps 160. Each dumbbell clamp 160 has a two spaced-apart plates 162 which are substantially identical in shape and are connected to one another by a post 164. The plates 162 have a notch 166 for receiving the grip 28 of the dumbbell 26. An elongated slot 168 intersects the notch 166. Slidably disposed within the slot 168 is a locking bar 170. Caps 172 are mounted to the locking bars 170 opposite one another and slidably engage the respective plates 162 adjacent the slots 168 to retain the locking bars 170 within the slots 168. A handle 174 is mounted to and extends between the locking bars 170. A spring 176 is disposed in each slot 168 to bias the locking bar 170 toward the notch 166 and removably engage the grip 28, thereby securing the grip 28 within the notch 166. A clamp bore 178 is provided to engage the J-hook and secure the dumbbell clamp 160 to the cable 72 as shown. By gripping and moving the handle 174 toward the post 164, the locking bars 170 are withdrawn from the notches 166. The dumbbell grip 28 is inserted into the notches 170, and the handle 174 is released. The springs 176 force the locking bars 170 toward the notches 166 and engage the grip 28, securing the grip within the notches 170. Another hand switch 88 extends between the plates 162 proximate the notches 166. Like the barbell 24, a female electrical receptacle 82 is operably connected to the hand switch 88. The male electrical connector 158 is removably connectable to the female receptacle 82. As with the hand switches 88 of the barbell 24 the hand switches 88 of both clamps 160 preferably must be engaged to actuate the pawls 120, thereby releasing the respective cables for independent reciprocating movement.

While exercising, should one hand of the weightlifter fail to activate either of the hand switches 88 of the barbell 24 or the dumbbell clamps 160, electrical power is interrupted to the solenoids 122. As a result, the pawls 120 engage the ratchet-sprocket gear 124 and secure the weight assembly from downward movement.

Referring again to FIG. 1, an extension switch 180 and a retraction switch 182 are mounted to the frame 32 and operably connected to the motor assembly 142 for selectively extending and retracting the cables 72, respectively, while the hand switches 88 are not activated. Activation of the extension switch 180 releases the motor brake 146 and activates the motor 144 to rotate the drive shaft 144 in a direction to extend the cables 72 from the booms 54. Likewise, activation of the retraction switch 182 releases the motor brake 146 and activates the motor 144 to rotate the drive shaft 114 in the opposite direction to retract the cables 72. By releasing either of the switches 180 and 182, electrical power to the motor 144 is interrupted and the motor brake 146 engages the motor 144, securing the drive shaft 114 from rotation.

Although not shown, counterbalance weights having the same weight as the counterweights 104 are mounted to either the cables 72 or to the barbell 24 and the dumbbell clamps 160. As such, the weightlifter is lifting the true weight of the weight assembly as in free-weight fashion.

In operation, the weightlifter depresses both hand switches 88 of the barbell 24 or the dumbbell clamps 160 to actuate the solenoids 122, which disengages the pawls 120 from the ratchet-sprocket gear 124 and releases the weight assembly for reciprocating vertical movement. Upon completion of the exercise, the weightlifter releases either or both of the hand switches 88, thereby interrupting electrical power to the solenoids 122 and causing the pawls 120 to engage the ratchet-sprocket gear 124 to secure the cables 72 from vertical movement.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. It is apparent that the J-shaped indentations 135 can be oriented in the opposite direction on the ratchet wheel portion 134 as shown in the aforementioned drawings, and accordingly is included within the scope of the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

We claim:

1. A dumbbell, dumbbell clamp and cable assembly for use with fitness apparatus comprising:

a dumbbell clamp comprising two spaced-apart side portions connected to one another and each side portion comprising a notch, and a slot intersecting said notch disposed on said at least one of said two spaced-apart side portions;

a dumbbell comprising a grip disposed in said notch of said two spaced-apart side portions;

a locking means comprising a locking bar slidably disposed within said slot disposed on at least one of said two spaced-apart side portions for locking said grip of said dumbbell in said notch; and a cable assembly comprising a first end connected to a support assembly of said fitness apparatus and a second end connected to said clamp.

2. The dumbbell, dumbbell clamp and cable assembly of claim 1 comprising a biasing means for biasing said locking bar toward said notch.

3. The dumbbell, dumbbell clamp and cable of claim 2 comprising a grip sensor disposed on a cross member between said two spaced-apart side portions.

4. A dumbbell and clamp for use with a fitness apparatus comprising:

a dumbbell having a grip;

a clamp comprising a dumbbell attachment means for attaching said grip of said dumbbell to said clamp; and a grip sensor attached to said clamp and disposed adjacent to said grip of said dumbbell when said dumbbell is attached to said clamp wherein grasping of said grip of said dumbbell actuates said grip sensor.

5. The dumbbell and clamp for use with fitness apparatus of claim 4 wherein said dumbbell attachment means comprises a grip notch in said clamp to retain said grip of said dumbbell.

6. A dumbbell and clamp for use with fitness apparatus comprising:

a dumbbell having a grip;

a clamp comprising two spaced-apart side portions, each of said two spaced-apart side portions comprising a grip notch retaining said grip of said dumbbell; and a cable attachment element disposed on said clamp;

wherein said grip notch comprises a first end open to an outside edge of said side portion and a second end comprising dimensions for retaining said grip of said dumbbell and said second end of said grip notch of each of said two spaced-apart plates is disposed lower than said first end of said grip notch when said cable attachment element is spaced vertically above said second end of said grip notch.

7. The dumbbell and clamp of claim 6 comprising a releasable lock disposed on said each of said two spaced-apart side portions for locking said grip in said grip notch.

8. The dumbbell and clamp of claim 7 wherein said releasable lock comprises a lock bar slidably engageable with said grip notch of said each of said two spaced-apart side portions.

9. The dumbbell and clamp of claim 6 comprising a grip sensor disposed on said clamp and disposed adjacent to said grip of said dumbbell when said dumbbell is attached to said clamp wherein grasping of said grip of said dumbbell actuates said grip sensor.

10. The dumbbell and clamp of claim 9 comprising a releasable electrical connector for operably connecting said grip sensor to an engagement element of said fitness apparatus.

* * * * *